US009051111B2

(12) United States Patent
Kuo et al.

(10) Patent No.: US 9,051,111 B2
(45) Date of Patent: Jun. 9, 2015

(54) PALLET

(71) Applicant: Shenzhen China Star Optoelectronics Technology Co., Ltd., Shenzhen, Guangdong (CN)

(72) Inventors: Yicheng Kuo, Shenzhen (CN); Shihhsiang Chen, Shenzhen (CN); Chengwen Que, Shenzhen (CN); Jiahe Cheng, Shenzhen (CN); Qinjun Shi, Shenzhen (CN); Jiaxin Li, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 475 days.

(21) Appl. No.: 13/806,803

(22) PCT Filed: Nov. 8, 2012

(86) PCT No.: PCT/CN2012/084258

§ 371 (c)(1),
(2) Date: Dec. 24, 2012

(87) PCT Pub. No.: WO2014/059711

PCT Pub. Date: Apr. 24, 2014

(65) Prior Publication Data

US 2014/0110291 A1 Apr. 24, 2014

(30) Foreign Application Priority Data

Oct. 19, 2012 (CN) ..... 2012 1 0401350

(51) Int. Cl.
*B65D 19/00* (2006.01)
*B65D 85/48* (2006.01)

(52) U.S. Cl.
CPC ..... *B65D 85/48* (2013.01); *B65D 19/0097* (2013.01); *B65D 2519/00034* (2013.01);

(Continued)

(58) Field of Classification Search
CPC .... B65D 19/0004; B65D 19/38; B65D 19/06; B65D 19/16; B65D 19/12; B65D 19/00
USPC ..... 206/386; 108/54.1; 40/741, 742; 248/172
See application file for complete search history.

(56) References Cited

U.S. PATENT DOCUMENTS 2,739,776 A 3/1956 Terando
2,873,934 A * 2/1959 Settles ..... 108/54.1

(Continued)

FOREIGN PATENT DOCUMENTS

CN 2468920 Y 1/2002
JP 6-72443 A 3/1994

(Continued)

*Primary Examiner* — Anthony Stashick
*Assistant Examiner* — Blaine Neway
(74) *Attorney, Agent, or Firm* — Andrew C. Cheng

(57) ABSTRACT

The present invention provides a pallet, which includes a base board and secondary boards movably coupled to the base board with coupling axles arranged therebetween. Each coupling axle includes a base from which an extension section extends. The extension section forms a plurality of flexible engagement keys. The base board forms receiving sections corresponding to the bases and track channels corresponding to the extension sections. Each track channel forms therein a plurality of groups of retention slots corresponding to the flexible engagement keys. The bases are respectively received in the receiving slots and movable in the receiving slots. The engagement keys are receivable in and retained by the retention slots to retain the coupling axles in the base boards. The extension sections have free ends respectively fixed in the secondary boards to movably couple the secondary boards to the base boar.

10 Claims, 3 Drawing Sheets

(52) U.S. Cl.
CPC ..... *B65D2519/00069* (2013.01); *B65D 2519/00273* (2013.01); *B65D 2519/00293* (2013.01); *B65D 2519/00323* (2013.01); *B65D 2519/00572* (2013.01); *B65D 2519/00766* (2013.01); *B65D 2519/00985* (2013.01)

(56) References Cited

U.S. PATENT DOCUMENTS

| | | | | | |
|---|---|---|---|---|---|
| 2,942,827 | A | * | 6/1960 | Edson | 108/54.1 |
| 2,972,463 | A | * | 2/1961 | Matthews et al. | 108/54.1 |
| 3,266,444 | A | * | 8/1966 | Budd | 108/54.1 |
| 3,590,510 | A | * | 7/1971 | Salz | 40/739 |
| 3,695,187 | A | * | 10/1972 | Weiss | 108/54.1 |
| 3,698,545 | A | * | 10/1972 | MacDonnell | 206/592 |
| 4,019,270 | A | * | 4/1977 | Trowbridge | 40/741 |
| 4,705,276 | A | * | 11/1987 | Kastle et al. | 273/309 |
| 4,922,834 | A | * | 5/1990 | Kraus | 108/57.13 |
| 5,706,738 | A | * | 1/1998 | Rapeli | 108/54.1 |
| 6,152,553 | A | * | 11/2000 | Wunderlich | 312/265.2 |
| 2002/0174807 | A1 | * | 11/2002 | Mason | 108/51.11 |

FOREIGN PATENT DOCUMENTS

| | | | |
|---|---|---|---|
| JP | 6-127549 | A | 5/1994 |
| JP | 2000-43868 | A | 2/2000 |

* cited by examiner

PALLET

BACKGROUND OF THE INVENTION

1. Field of the Invention

The present invention relates to the field of packaging material, and in particular to a pallet used in a liquid crystal panel package box.

2. The Related Arts

In the field of manufacture of liquid crystal display devices, the manufacture of liquid crystal display devices includes a process of assembling, which assembles various components, including a liquid crystal panel, a main control circuit, and an enclosure, together. These components are each manufactured in advance and packaged for being later assembled to form a complete liquid crystal display device. The liquid crystal panel, after being manufactured, are packaged in a package box and then shipped to a corresponding assembling station with the box. The package box is generally integrally formed with blow molding and has a bottom at which a pallet is mounted to support liquid crystal panels stacked thereon. Such a pallet is generally rigid and unitary and is thus only fit for a specific size of liquid crystal panel. In addition, the amount of space that it takes for warehousing and transportation is relatively large, making it hard for cost control.

SUMMARY OF THE INVENTION

An object of the present invention is to provide a pallet, which has an adjustable size to be fit for packaging of various sizes of liquid crystal panel and occupies a small amount of space for warehousing and transportation.

To achieve the object, the present invention provides a pallet, which comprises a base board and secondary boards movably coupled to corners of the base board. Coupling axles are arranged between the base board and the secondary boards. The coupling axles each comprise a base and an extension section extending from the base. The extension section forms a plurality of flexible engagement keys close to an end thereof adjacent to the base. The base board forms receiving sections respectively corresponding to the bases and track channels respectively corresponding to the extension sections. The track channels each form therein a plurality of groups of retention slots corresponding to the flexible engagement keys. The bases are respectively received in the receiving slots and movable in the receiving slots. The engagement keys are receivable in and retained by the retention slots to retain the coupling axles in the base boards. The extension sections have free ends respectively fixed in the secondary boards to movably couple the secondary boards to the base board.

The base board is of a square shape and comprises a bottom face, a top face opposite to the bottom face, and four side faces connecting between the bottom face and the top face 此 Every two adjacent ones of the side faces form a corner at connection thereof. The secondary boards are of an L-shape arranged outboard the corners.

Each of the corners forms a first end face opposing the respective secondary board. The coupling axle extends from the first end face to outside the base board.

The secondary boards each form a second end face corresponding to the first end face and opposing the base board. The coupling axles extend through the second end faces into the secondary boards to fixedly connect to the secondary boards.

The second end face forms a mounting hole corresponding to the extension section of the coupling axle. The coupling axle is fixedly mounted in the mounting hole.

The extension section is cylindrical and the plurality of flexible engagement keys is circumferentially formed on an outside surface of the extension section at locations close to the base.

The flexible engagement keys are of a number of four.

Each of the groups of the retention slots comprises four slots. The four slots respectively receive four flexible engagement keys.

The base, the extension section, and the flexible engagement keys are integrally formed together.

The present invention also provides a pallet, which comprises a base board and secondary boards movably coupled to corners of the base board, coupling axles being arranged between the base board and the secondary boards, the coupling axles each comprising a base and an extension section extending from the base, the extension section forming a plurality of flexible engagement keys close to an end thereof adjacent to the base, the base board forming receiving sections respectively corresponding to the bases and track channels respectively corresponding to the extension sections, the track channels each forming therein a plurality of groups of retention slots corresponding to the flexible engagement keys, the bases being respectively received in the receiving slots and movable in the receiving slots, the engagement keys being receivable in and retained by the retention slots to retain the coupling axles in the base boards, the extension sections having free ends respectively fixed in the secondary boards to movably couple the secondary boards to the base board;

wherein the base board is of a square shape and comprises a bottom face, a top face opposite to the bottom face, and four side faces connecting between the bottom face and the top face, every two adjacent ones of the side faces forming a corner at connection thereof, the secondary boards being of an L-shape arranged outboard the corners;

wherein each of the corners forms a first end face opposing the respective secondary board, the coupling axle extending from the first end face to outside the base board;

wherein the secondary boards each form a second end face corresponding to the first end face and opposing the base board, the coupling axles extending through the second end faces into the secondary boards to fixedly connect to the secondary boards;

wherein the second end face forms a mounting hole corresponding to the extension section of the coupling axle, the coupling axle being fixedly mounted in the mounting hole;

wherein the extension section is cylindrical and the plurality of flexible engagement keys is circumferentially formed on an outside surface of the extension section at locations close to the base;

wherein the flexible engagement keys are of a number of four;

wherein each of the groups of the retention slots comprises four slots, the four slots respectively receiving four flexible engagement keys; and wherein the base, the extension section, and the flexible engagement keys are integrally formed together.

The efficacy of the present invention is that the present invention provides a pallet, which comprises coupling axles that makes secondary boards position-adjustable with respect to a base board for adjusting the size of the pallet, enabling application of the pallet to package of liquid crystal panels of various sizes. The pallet can be shrunk to the minimum volume in warehousing and transportation so that the amount of space occupied is small and the transportation cost is effectively reduced.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
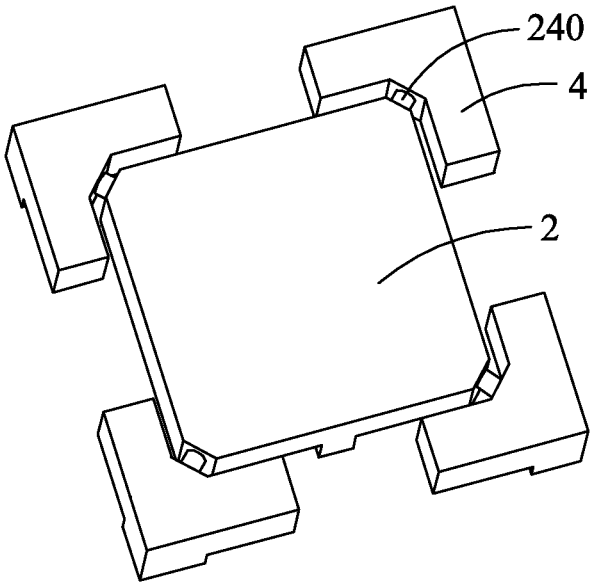
FIG. 1 is a schematic view showing the front-side structure of a pallet according to the present invention.
Figure 2:
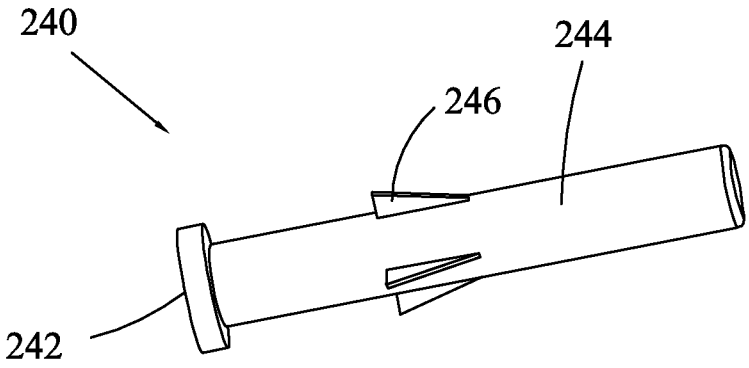
FIG. 2 is a schematic view showing the structure of a coupling axle of the pallet according to the present invention.
Figure 3:
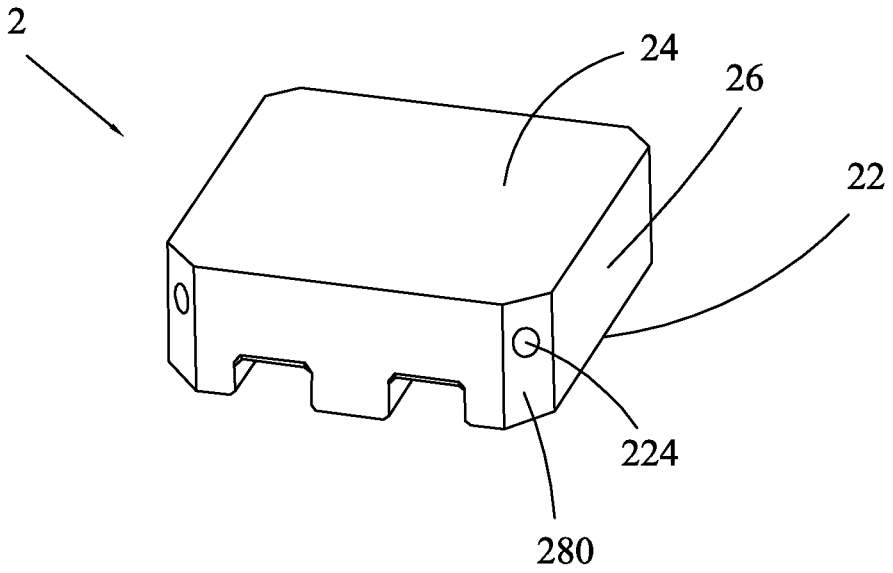
FIG. 3 is a schematic view showing the structure of a base board of FIG. 1.
Figure 4:
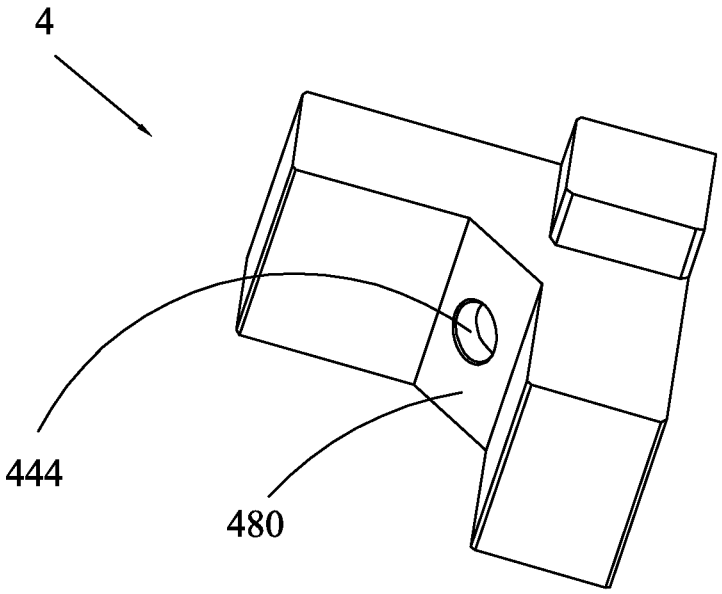
FIG. 4 is a schematic view showing the structure of a secondary board of FIG. 1.
Figure 5:
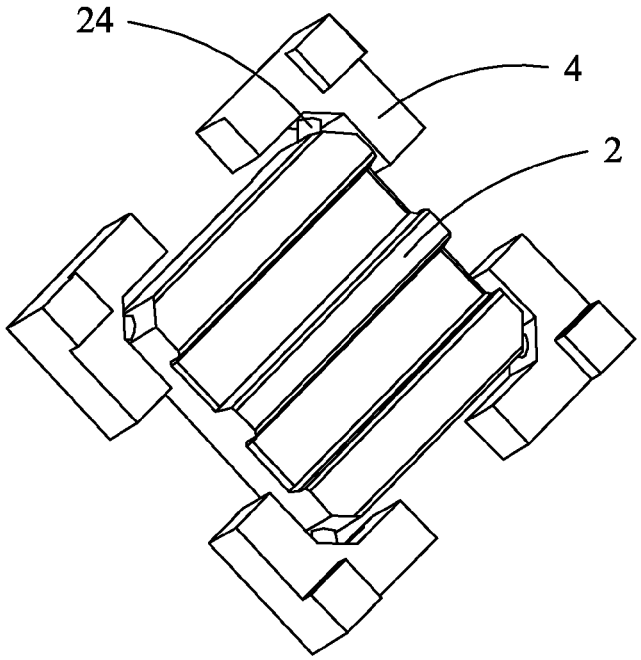
FIG. 5 is a schematic view showing the back-side structure of the pallet according to the present invention
Figure 6:
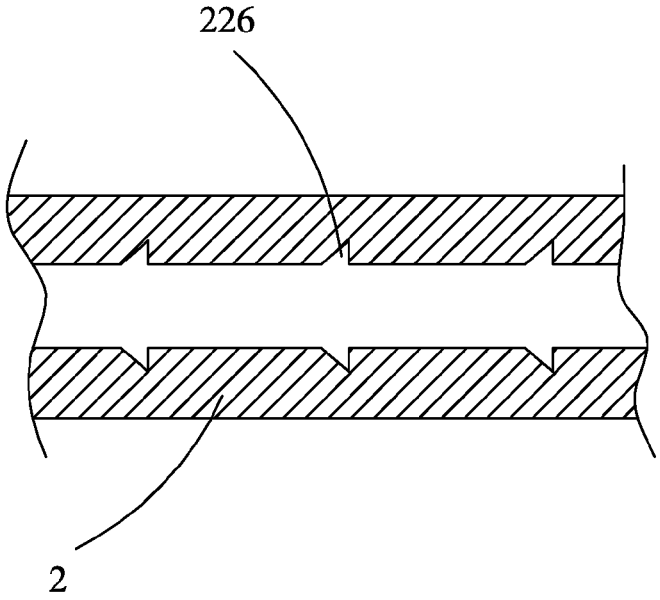
FIG. 6 is a cross-sectional view showing a track channel of the pallet according to the present invention.

Referring to FIGS. 1-6, the present invention provides a pallet, which comprises a base board 2 and secondary boards 4 movably coupled to corners of the base board 2. Coupling axles 240 are provided between the base board 2 and the secondary boards 4. The secondary boards 4 are movable along the coupling axles 240 with respect to the base board 2 so as to change the overall size of the pallet to thereby widen the applications thereof and lower down the manufacturing cost.

The coupling axles 240 each comprise a base 242 and an extension section 244 extending from the base 242. The extension section 244 forms a plurality of flexible engagement keys 246 at locations close to an end thereof that is adjacent to the base 242. In the instant embodiment, the base 242, the extension section 244, and the flexible engagement keys 246 are integrally formed together.

The base board 2 forms receiving sections (not shown) corresponding to the bases 242 and track channels 224 corresponding to the extension sections 244. The track channels 224 each form therein a plurality of groups of retention slots 226 corresponding to the flexible engagement keys 246. The bases 242 are respectively received in the receiving slots and are movable in the receiving slots. The engagement keys 246 are receivable in and retained by the retention slots 226 to thereby retain the coupling axles 240 in the base board 2. Free ends of the extension sections 244 are respectively fixed in the secondary boards 4 to thereby movably couple the secondary boards 4 to the base board 2. The coupling axles 240 may be of a number that is determined according to practical needs. In the instant embodiment, each of the secondary boards 4 is coupled by one of the coupling axles 240 to the base board 2.

The base board 2 is of a square shape and comprises a bottom face 22, a top face 24 opposite to the bottom face 22, and four side faces 26 connecting between the bottom face 22 and the top face 24. Every two adjacent ones of the side faces 26 form a corner at connection thereof. The secondary boards 4 are of an L-shape arranged outboard the corners.

Each corner of the base board 2 forms a first end face 280 opposing the secondary board 4. The coupling axle 240 extends from the first end face 280 to outside the base board 2. The secondary boards 4 each form a second end face 480 corresponding to the first end face 280 and opposing the base board 2. The coupling axles 240 extend through the second end faces 480 into the secondary boards 4 to fixedly connect to the secondary boards 4. The second end face 480 forms a mounting hole 444 corresponding to the extension section 244 of the coupling axle 240. The coupling axle 240 is fixedly mounted in the mounting hole 444. Preferably, the extension section 244 is cylindrical and the plurality of flexible engagement keys 246 is circumferentially formed on an outside surface of the extension section 244 at locations close to the base 242. In the instant embodiment, the flexible engagement keys 246 are of a number of four. Each group of retention slots 226 comprises four slots for respectively receiving the four flexible engagement keys 246.

When it is desired to have a large-sized pallet, the secondary boards 4 are pulled outward. The flexible engagement keys 246, being flexible, undergo deformation when acted upon by a force to disengage from the ends of the retention slots 226 that are close to the receiving slots for movement along the track channels 224 and restore shape, through elastic deformation, to engage and thus retain in the next group of retention slots 226 when reach the next group of the retention slots 226 thereby realizing expansion of the size of the pallet. When it is desired to have a small-sized pallet, such a pallet can be realized through pushing the secondary boards 4 into the base board 2 and the operation is easy.

It is noted that sizes of the base board 2 and the secondary boards 4 can be properly designed according to practical needs and the flexible engagement keys 246 of the coupling axles 24 and the plurality of groups of retention slots 226 formed in the track channels 224 can be properly designed in respect to the locations and spacing intervals according to practical needs. For example, the design can be made for a pallet that is capable of transporting liquid crystal display panel of a size of 28 inches, 32 inches, or 46 inches. The details of parameters can be set according to practical needs and this is of no influence on the technical effectiveness of the present invention.

In summary, the present invention provides a pallet, which comprises coupling axles that makes secondary boards position-adjustable with respect to a base board for adjusting the size of the pallet, enabling application of the pallet to package of liquid crystal panels of various sizes. The pallet can be shrunk to the minimum volume in warehousing and transportation so that the amount of space occupied is small and the transportation cost is effectively reduced.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A pallet, comprising a base board and secondary boards movably coupled to corners of the base board, coupling axles being arranged between the base board and the secondary boards so that the secondary boards define an article bearing surface, the coupling axles each comprising a base and an extension section extending from the base, the extension section forming a plurality of flexible engagement keys close to an end thereof adjacent to the base, the base board forming receiving sections respectively corresponding to the bases and track channels respectively corresponding to the extension sections, the track channels each forming therein a plurality of groups of retention slots corresponding to the flexible engagement keys, the bases of the coupling axles being respectively received in the receiving sections of the base board in such a way that the extension sections of the coupling axles are movable in the track channels to allow the engagement keys to be selectively receivable in and retained by the retention slots of one of the groups so as to retain the coupling axles in the base boards, the extension sections having free ends respectively fixed in the secondary boards to movably couple the secondary boards to the base board, wherein each of the coupling axles is of an axisymmetric configuration with the flexible engagement keys being distributed along a circumference of the axle in an equally-spaced manner, each of the engagement keys having a triangular configuration comprising a slope edge facing a predetermined direction in which the extension section is movable and a straight edge facing a direction opposite to the predetermined direction to an axis of the extension section for effecting enhanced positioning of the extension section in said opposite direction.

2. The pallet as claimed in claim 1, wherein the base board is of a square shape and comprises a bottom face, a top face opposite to the bottom face, and four side faces connecting between the bottom face and the top face, every two adjacent ones of the side faces forming a corner at connection thereof, the secondary boards being of an L-shape arranged outboard the corners.

3. The pallet as claimed in claim 2, wherein each of the corners forms a first end face opposing the respective secondary board, the coupling axle extending from the first end face to outside the base board.

4. The pallet as claimed in claim 3, wherein the secondary boards each form a second end face corresponding to the first end face and opposing the base board, the coupling axles extending through the second end faces into the secondary boards to fixedly connect to the secondary boards.

5. The pallet as claimed in claim 4, wherein the second end face forms a mounting hole corresponding to the extension section of the coupling axle, the coupling axle being fixedly mounted in the mounting hole.

6. The pallet as claimed in claim 1, wherein the extension section is cylindrical and the plurality of flexible engagement keys is circumferentially formed on an outside surface of the extension section at locations close to the base.

7. The pallet as claimed in claim 6, wherein the flexible engagement keys are of a number of four.

8. The pallet as claimed in claim 7, wherein each of the groups of the retention slots comprises four slots, the four slots respectively receiving four flexible engagement keys.

9. The pallet as claimed in claim 1, wherein the base, the extension section, and the flexible engagement keys are integrally formed together.

10. A pallet, comprising a base board and secondary boards movably coupled to corners of the base board, coupling axles being arranged between the base board and the secondary boards so that the secondary boards define an article bearing surface, the coupling axles each comprising a base and an extension section extending from the base, the extension section forming a plurality of flexible engagement keys close to an end thereof adjacent to the base, the base board forming receiving sections respectively corresponding to the bases and track channels respectively corresponding to the extension sections, the track channels each forming therein a plurality of groups of retention slots corresponding to the flexible engagement keys, the bases of the coupling axles being respectively received in the receiving sections of the base board in such a way that the extension sections of the coupling axles are movable in the track channels to allow the engagement keys to be selectively receivable in and retained by the retention slots of one of the groups so as to retain the coupling axles in the base boards, the extension sections having free ends respectively fixed in the secondary boards to movably couple the secondary boards to the base board, wherein each of the coupling axles is of an axisymmetric configuration with the flexible engagement keys being distributed along a circumference of the axle in an equally-spaced manner, each of the engagement keys having a triangular configuration comprising a slope edge facing a predetermined direction in which the extension section is movable and a straight edge facing a direction opposite to the predetermined direction to an axis of the extension section for effecting enhanced positioning of the extension section in said opposite direction;

wherein the base board is of a square shape and comprises a bottom face, a top face opposite to the bottom face, and four side faces connecting between the bottom face and the top face, every two adjacent ones of the side faces forming a corner at connection thereof, the secondary boards being of an L-shape arranged outboard the corners;

wherein each of the corners forms a first end face opposing the respective secondary board, the coupling axle extending from the first end face to outside the base board;

wherein the secondary boards each form a second end face corresponding to the first end face and opposing the base board, the coupling axles extending through the second end faces into the secondary boards to fixedly connect to the secondary boards;

wherein the second end face forms a mounting hole corresponding to the extension section of the coupling axle, the coupling axle being fixedly mounted in the mounting hole;

wherein the extension section is cylindrical and the plurality of flexible engagement keys is circumferentially formed on an outside surface of the extension section at locations close to the base;

wherein the flexible engagement keys are of a number of four;

wherein each of the groups of the retention slots comprises four slots, the four slots respectively receiving four flexible engagement keys; and wherein the base, the extension section, and the flexible engagement keys are integrally formed together.

* * * * *